US007310896B2

(12) United States Patent
Lopata

(10) Patent No.: US 7,310,896 B2
(45) Date of Patent: Dec. 25, 2007

(54) MECHANIZED UNIT FOR PROTECTIVELY ENCASING A UTILITY IN A TRENCH WITH PROCESSED EXCAVATED TRENCH MATERIAL

(75) Inventor: Michael E. Lopata, Clinton, NY (US)

(73) Assignee: PLC Trenching Co., LLC, Clinton, NY (US)

( * ) Notice: Subject to any disclaimer, the term of this patent is extended or adjusted under 35 U.S.C. 154(b) by 50 days.

(21) Appl. No.: 11/323,141

(22) Filed: Dec. 30, 2005

(65) Prior Publication Data

US 2006/0156589 A1 Jul. 20, 2006

Related U.S. Application Data

(63) Continuation-in-part of application No. 10/722,658, filed on Nov. 24, 2003, now Pat. No. 6,981,342.

(51) Int. Cl.
*E02F 5/22* (2006.01)
*E02F 5/10* (2006.01)

(52) U.S. Cl. ..... 37/142.5; 405/179; 405/180

(58) Field of Classification Search ..... 37/142.5, 37/91; 405/179, 182; 209/260, 235, 418–421, 209/245, 248, 249; 241/101.7, 101.74, 8, 241/68

See application file for complete search history.

(56) References Cited

U.S. PATENT DOCUMENTS

| | | | | |
|---|---|---|---|---|
| 4,812,078 | A | 3/1989 | Rivard et al. | |
| 5,261,171 | A * | 11/1993 | Bishop | 37/142.5 |
| 5,386,914 | A * | 2/1995 | Eramaja et al. | 209/673 |
| 5,938,373 | A | 8/1999 | Scudder | |
| 6,318,930 | B1 * | 11/2001 | Scudder | 405/179 |
| 6,558,075 | B2 * | 5/2003 | Benedict et al. | 405/21 |
| 6,981,342 | B2 * | 1/2006 | Lopata | 37/142.5 |
| 7,204,046 | B2 * | 4/2007 | Currey | 37/142.5 |

* cited by examiner

*Primary Examiner*—Thomas B. Will
*Assistant Examiner*—Mai T Nguyen
(74) *Attorney, Agent, or Firm*—Darby & Darby PC

(57) ABSTRACT

A mechanized unit that is moved through a trench in the ground for the purpose of placing a length or lengths of a utility or utilities by a guide device on the bottom of the trench, and then encasing the placed utility or utilities. The unit has at least one plow to sweep the material excavated from the ground to form the trench back into the trench onto a screening member mounted to the movable unit. The screening unit has sections of progressively larger openings from front to rear. The screening member preferably is vibrated to deposit onto the one or more utilities layers of the excavated material having particles of progressively larger size from the bottom toward the top of the trench to protect the utility or utilities from physical damage caused by larger excavated particles.

10 Claims, 2 Drawing Sheets

MECHANIZED UNIT FOR PROTECTIVELY ENCASING A UTILITY IN A TRENCH WITH PROCESSED EXCAVATED TRENCH MATERIAL

RELATED APPLICATION

This application is a continuation-in-part of application Ser. No. 10/722,658, filed Nov. 24, 2003, which issued as U.S. Pat. No. 6,981,342 on Jan. 3, 2006.

BACKGROUND OF THE INVENTION

Mechanized units are known that are moved through a trench in the ground for the purpose of laying a continuous length or connected lengths of a utility or utilities, such as conduits, pipes, cables, etc. or combinations thereof. The mechanized unit is primarily intended to place in the trench flexible utilities such as electrical and communication and data cables or rigid pipes for water, sewer, and/or gas, or any combination thereof, and then encase the one or more utilities with protective material. The mechanized unit may be propelled through the trench by being connected directly to the device that excavates the trench or by any other mechanical moving device, such as a tractor or other vehicle.

In one type of application, the flexible utility or utilities pass down through the unit onto the bottom of the trench by means of a guide device that maintains a desired spatial relationship between utilities in applications in which more than one utility is laid in the trench. As the utility or utilities pass through and/or exit the guide device, protective material, which has been deposited in the upper portion of the mechanized unit, gravitates in a generally vertical direction through the mechanized unit, onto and around the utility or utilities being installed. This type of installation has a disadvantage in that the material to be used for the encasement must be specially obtained, usually by purchasing, from a suitable processing facility, such as a gravel/sand pit or stone quarry. Alternatively, the encasement material must be processed on site using portable screening equipment. The purchasing, hauling and handling or processing and handling of this protective material can add considerable time and costs to the installation.

U.S. Pat. No. 6,981,342, which is assigned to the assignee of the subject application and whose disclosure is incorporated herein in its entirety by reference, describes a mechanized unit that overcomes the forgoing disadvantages in an application that uses excavated trench material and that protects the utility or utilities in a trench in a manner that is efficient and cost effective.

In accordance with the invention of the aforesaid patent, a mechanized unit is provided that places a continuous length or connected lengths of a utility or utilities at a predetermined spatial relationship with each other near the bottom of an excavated trench. As the mechanized unit moves along the trench, it sweeps the excavated material that has been placed along the one or both sides of the trench back into the trench onto a screening member. The screening member is constructed with vertically separate layers of screening material with the screen layers from top to bottom having progressively smaller openings. The screening member is mounted to the unit with a downward slope from the front to the back in the direction of unit movement. As the unit moves, layers of the excavated material of increasing particle size are deposited over the utility or utilities one layer above the other. The layer of smallest particles directly encase the utility or utilities rather than larger size particles. This protects the utility or utilities from stresses or direct physical damage that would be caused by large excavated soil or rock particles. The successive upper layer or layers further protect the utility. The mechanized unit of the invention accomplishes this in one continuous operation together with the laying of the one or more utilities.

The mechanized unit of the patent is provided with vertical side walls that hold back the sides of the trench. This prevents collapse of the trench walls and also prevents any material from falling into the trench which could damage the utility or utilities being installed prior to their encasement by the protective screened material.

BRIEF DESCRIPTION OF THE INVENTION

In accordance with the invention, a mechanized unit of the foregoing type is provided with a simplified screening member that is used to deposit layers of the excavated material of increasing particle size onto the one or more utilities in an excavated trench. The screening member of the invention has only a single screen layer with sections of openings of different sizes. That is, the screening member extends in a downward sloping direction from the direction of travel of the unit and the screening member has two or more sections of openings. The openings of each section are of substantially the same size and the openings of the respective sections progressively increase in size from the front (higher) end of the screening member to the rear (lower). Thus, as the excavated material is swept from the trench wall onto the screening member, the smaller size particles will pass through the smaller size openings first and form a layer that encases the one or more utilities, this being followed by a successive layer or layers of fill material particles of larger size one on top of the other that pass through the large size openings of the respective sections. In a preferred embodiment, a shaker shakes the screening member.

BRIEF DESCRIPTION OF THE DRAWINGS

Other objects and advantages of this invention will become more apparent by referring to the following description of operation and referring to the accompanying drawings, in which.

DETAILED DESCRIPTION OF THE INVENTION

Figure 1:
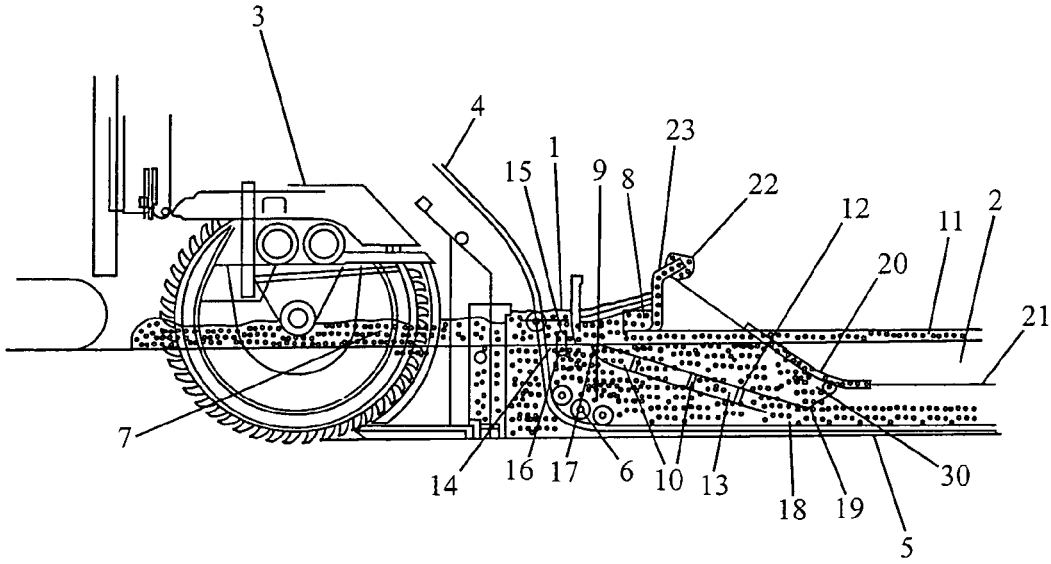
FIG. 1 is a side elevational view in cross-section of the mechanized unit.

Referring to the drawings, the mechanized unit 1 of the invention is pulled (from right to left as shown in FIG. 1) through a trench 2 by a conventional trencher unit 3, illustratively of the wheel type, which excavates the trench. Such trencher units 3 dig a trench of predetermined depth and width as it moves along the ground. Any other suitable mechanism can be used to excavate the trench and the trench also can be hand dug. As the trencher 3 moves it deposits the material 7 that has been excavated along one or both sides of the top 11 of the trench 2.

The mechanized unit 1 has a frame to which is mounted a pair of vertical side walls 30 formed by metal plates that are spaced apart by a distance generally corresponding to the space between the trench walls. As the mechanized unit 1 moves forward, the utility or utilities 4 being installed pass down from a supply source (not shown) through the mechanized unit 1 and into the trench 2. The supply source for the one or more utilities 4 can be, for example, one or more reels of cable that are carried by the unit 1 or by a vehicle moving in parallel with unit 1 along the trench 2, or pieces of pipe that are laid down and are joined together. The one or more utilities 4 are positioned near the bottom of the trench 2, by means of a guide device 6 which can be formed of a plurality of rollers or chutes, as appropriate. If more than one utility is being laid in the trench, the guide device 6 is preferably configured to maintain a desired spatial relationship between the one or more utilities. The unit side walls 30 prevent the trench from collapsing and protect the utility or utilities as they are laid in the trench.

Figure 2:
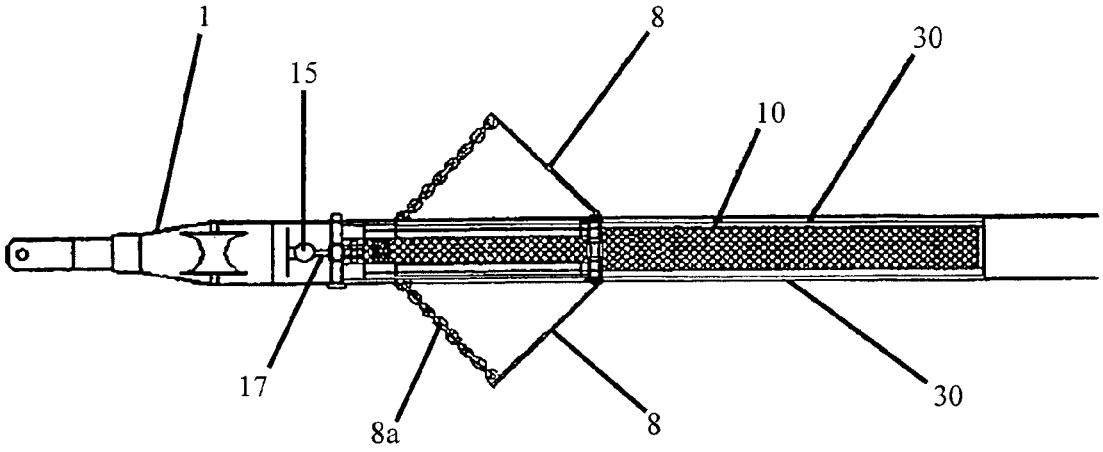
FIG. 2 is a top view.

A plow 8 is mounted to each side of the frame of the mechanized unit 1 at an angle, for example, about 45°. If the excavated material is placed on only one side of the trench, then only one plow is needed. The plows 8 are above the trench top 11 and contact the excavated material 7 deposited along the one or both sides of the top 11 of trench 2. As the mechanized unit is moved forward, the plows 8 sweep the material 7 back into the trench 2 onto the top of a screening member 10, described below, mounted to the frame of the mechanized unit 1. As shown in FIG. 2, the ends of the plows 8 are stabilized by chains 8*a* or rigid struts connected to the frame of the unit. The height of plows 8 is raised and lowered, preferably by a hydraulic device 9, or by any other mechanical means, for example a threaded screw arrangement, so that the appropriate amount of excavated material 7 is plowed back into the trench 2.

Figure 3:
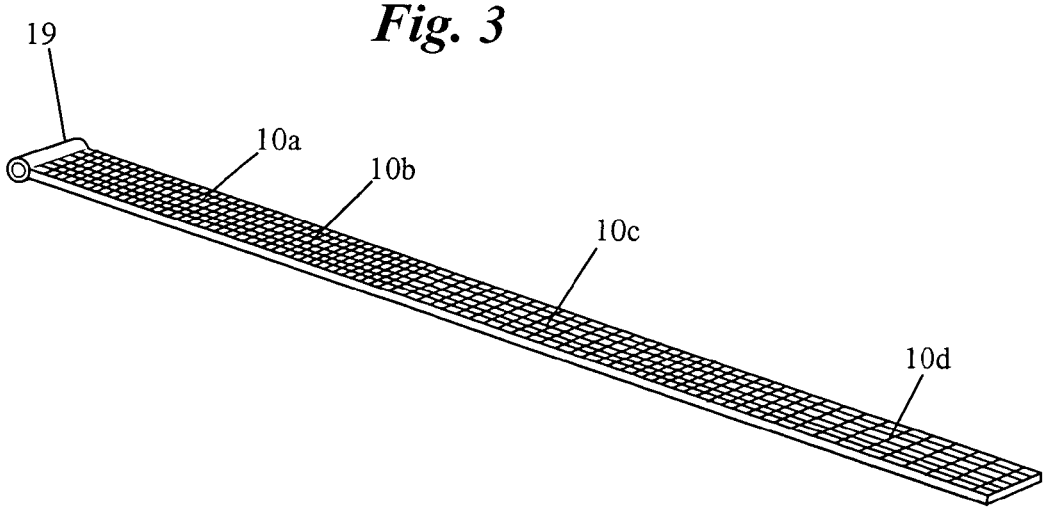
FIG. 3 is a orthographical view of the screening member.

Referring to FIG. 3, the screening member 10 has a frame having an end 19 pivotally connected to the frame of mechanized unit 1 and extends below the top 11 of the trench 2. The screening member 10 fits between the mechanized unit side walls 30 and slopes in a downward direction away from the rear of the unit 1. The screening member 10 has one layer and a plurality of screen sections of different size, or mesh size. Each plurality of openings of a section is of substantially the same size, but the sizes of the openings progressively increase from section to section toward the rear of the screening member. As seen in FIG. 3, the screening member 10 single layer illustratively has four sections 10*a*, 10*b*, 10*c* and 10*d* with progressively larger openings (mesh size) front to rear. That is, the openings of each of the sections is of the same size. The openings of section 10*b* are larger than those of section 10*a*, the openings of section 10*c* are larger than those of 10*b*, and the openings of section 10*d* are larger than those of section 10*c*. While four sections 10*a*-10*d* are shown, there can be fewer, but at least two, or more than four.

As the mechanized unit 1 moves forward in the trench the smaller particles that pass through the smaller openings of the section 10*a* openings toward the front of the screening member 10 gravitate to encase and cover the utility or utilities 4 at the bottom of the trench 2 prior to the larger particles passing through the larger openings of sections 10*b*, 10*c* and 10*d* toward the rear of the screening member 10 gravitating onto the smaller particles previously deposited. Particles that are larger than the openings of all of the sections slide off the lower end of the screening member into the trench to form the top layer of the encasement. This covers the utility or utilities 4 with protective material from bottom to top with particle sizes that are progressively smaller to larger. While the screening member 10 is shown with four sections of openings of different sizes, there can be two or more.

In a typical embodiment, the screening member 10 has a downward slope of about 18°, a width of 12 inches, and a length of 8 feet. The openings of section 10*a* are ⅜", those of section 10*d* are 1", and those of sections 10*b* and 10*c* of increasing size from between ⅜" to 1". All of the foregoing dimensions are by way of illustration only and can be varied to suit a particular application.

A shaker 14 formed by a hydraulic motor 15 or any other mechanical means is mounted to the unit 1 framework. The motor 15 turns a crankshaft 16 that is connected to the screening member 10 frame by a connecting rod 17. The shaker 14 is operated at a desired rate and preferably has a movement that moves the screening member 10 by a desired distance forward and back and up-and-down. Any suitable conventional type of shaking or vibrating device can be utilized.

As the excavated material passes vertically through the openings of sections 10*a*, 10*b*, 10*c* and 10*d* of the screening member 10, it is separated by particle size. In the embodiment shown, as the mechanized unit 1 moves forward, the screening member causes four layers of encasing material of progressively larger particle size to be laid over the one or more utilities 4. The first layer is the smallest particle size material 18 that passes through the openings of the screening member section 10*a*. The smallest size particles pass through the first screen section 10*a* to directly contact and cover the utility or utilities 4 that have been placed near the bottom of the trench 2. If the one or more utilities are slightly raised from the trench floor, the smaller size particles will flow below them and form a bed. The second, third and fourth layers are the particles of material that have passed through the progressively larger openings of the successive sections 10*b*, 10*c* and 10*d*.

The large particles that do not pass through any of the openings of sections 10*a*-10*d* gravitate down along the upper surface of the screen and are shaken down and to the rear of that screen until they fall off of the back end of the screen and gravitate onto the already deposited layers of material. Even though the size of these largest particles falling off the end of the screen may be relatively large, they do not damage the one or more utilities laid in the trench since these are already covered by four layers of material of smaller particle size. Also, the force of the large particles sliding off the screen is relatively small as compared to a direct vertical drop of such large size particles. Accordingly, as seen, the screening member 10 functions to cover the utility or utilities with layers of protective materials of successively increasing particle size.

While the illustrative embodiment of screening member 10 has only one layer, five layers of particles will be provided, these being the layer of particles from each of the four screening sections 10*a*, 10*b*, 10*c* and 10*d*, and the particles that fall off the end of the screen.

A guide device 20 preferably is attached at the rear of the mechanized unit 1 to place a warning ribbon 21 in the trench above the installed utility or utilities. The roll of warning ribbon 22 is supported by a warning ribbon roll support 23 attached to the unit 1 framework.

Specific features of the invention are shown in one or more of the drawings for convenience only, as each feature may be combined with other features in accordance with the invention. Alternative embodiments will be recognized by those skilled in the art and are intended to be included within the scope of the claims.

I claim:

1. A movable unit for screening excavated material to protectively cover or encase one or more utilities in an excavated trench in the ground comprising:

a screening member of a single layer screen mounted to the unit so as to be located below the ground surface within the trench and above the one or more utilities in the trench, said screening member having a plurality of sections of openings of progressively increasing size relative to the front of the unit;

a plow for sweeping excavated material lying along at least one side of the excavated trench onto said screening member, wherein the excavated material swept onto said screening member passes through the sections of openings of progressively increasing size to deposit layers of particles of the excavated material of progressively increasing size onto the utility or utilities installed in the trench as the unit moves.

2. The movable unit as claimed in claim 1, and further comprising a guide for placing a length of at least one utility into the trench onto which the screened material is deposited in the french as the unit moves.

3. The movable unit as claimed in claim 1 wherein said screening member is mounted to said movable unit with a downward slope in the trench away from the direction of movement of the movable unit.

4. The movable unit as claimed in claim 1 and further comprising a shaker unit counected to said screening member to shake said screening member to facilitate passage of particles through the openings of said at least one screen.

5. The movable unit as claimed in claim 3 and further comprising a shaker unit connected to said screening member to shake said screening member to facilitate passage of particles through the openings of said screen.

6. The movable unit as claimed in claim 1 wherein said screening member comprises a single layer screen having first and second sections of openings, with said openings of said second section being larger than the openings of said first section, whereby a first layer of smallest size particles passing through the openings of said first section are deposited on at least one utility in the trench, and a second layer of particles of a size larger than the openings of said first section pass through the openings of said second section to deposit a second layer of particles on said first layer, and particles larger than the openings of said second screen sliding off of the top surface of said screening member to form a third layer of particles.

7. The movable unit as claimed in claim 4 wherein said screening member is mounted to said movable unit with a downward slope in the trench away from the direction of movement of the movable unit so that particles of a size larger than the openings of said plurality of sections slide off of the screening member onto the uppennost layer of particles deposited through said screening member.

8. The movable unit as claimed in claim 5 wherein said screening member has four sections of openings of different size.

9. The movable unit as claimed in claim 1 and lhrther comprising a vertical plate mounted on each side of said movable unit to support a wall of the trench to prevent material from falling onto at least one installed utility being covered by the layers of the particles.

10. The movable unit as claimed in claim 1, and further comprising a means for adjusting the height of said plow relative to the top of the trench.

* * * * *